US009493900B2

(12) United States Patent
Ban et al.

(10) Patent No.: US 9,493,900 B2
(45) Date of Patent: Nov. 15, 2016

(54) WASHING MACHINE AND DETERGENT DELIVERY PUMP ASSEMBLY THEREOF

(71) Applicant: WUXI LITTLE SWAN CO., LTD., Jiangsu (CN)

(72) Inventors: Yong Ban, Jiangsu (CN); Lidong Wang, Jiangsu (CN)

(73) Assignee: Wuxi Little Swan Co., Ltd., Wuxi, Jiangsu (CN)

( * ) Notice: Subject to any disclaimer, the term of this patent is extended or adjusted under 35 U.S.C. 154(b) by 88 days.

(21) Appl. No.: 14/387,185

(22) PCT Filed: Mar. 22, 2013

(86) PCT No.: PCT/CN2013/073091
§ 371 (c)(1),
(2) Date: Sep. 22, 2014

(87) PCT Pub. No.: WO2013/139311
PCT Pub. Date: Sep. 26, 2013

(65) Prior Publication Data

US 2015/0075230 A1 Mar. 19, 2015

(30) Foreign Application Priority Data

Mar. 22, 2012 (CN) ..... 2012 1 0077617

(51) Int. Cl.
*D06F 39/02* (2006.01)
*D06F 39/08* (2006.01)
(Continued)

(52) U.S. Cl.
CPC ..... *D06F 39/02* (2013.01); *D06F 33/02* (2013.01); *D06F 39/022* (2013.01);
(Continued)

(58) Field of Classification Search
CPC ..... D06F 38/02; D06F 21/00; D06F 23/00; D06F 25/00; D06F 3/02; D06F 25/009;
(Continued)

(56) References Cited

U.S. PATENT DOCUMENTS 3,855,129 A * 12/1974 Abrahams ..... F04B 11/0058 210/137
5,088,902 A * 2/1992 Marioni ..... F04B 9/02 137/512.4
2012/0006077 A1* 1/2012 Mun ..... D06F 39/003 68/17 R

FOREIGN PATENT DOCUMENTS

CN 1225958 A 8/1999
CN 1461844 A 12/2003
(Continued)

OTHER PUBLICATIONS

PCT/CN2013/073091 English Translation of the International Search Report mailed Jun. 27, 2013, 4 pages.

*Primary Examiner* — Joseph L Perrin
(74) *Attorney, Agent, or Firm* — Lathrop & Gage LLP

(57) ABSTRACT

A washing machine and a detergent delivery pump assembly thereof are provided. The detergent delivery pump assembly includes a pump defining a plurality of fixed-volume chambers therein for containing detergents respectively, each fixed-volume chamber being provided with a liquid inlet valve and a liquid outlet valve; a plurality of pistons disposed in the plurality of fixed-volume chambers in one-to-one correspondence relationship and each including a piston head, the piston head being controlled to reciprocate in the fixed-volume chamber to draw or push out a fixed volume of detergent; a motor assembly; and a transmission mechanism to associate the piston heads with the motor assembly, such
(Continued)

that the piston heads are controlled to move in the fixed-volume chambers by the motor assembly.

16 Claims, 3 Drawing Sheets

(51) Int. Cl.

| | |
|---|---|
| ***F04B 9/02*** | (2006.01) |
| ***F04B 23/06*** | (2006.01) |
| ***D06F 33/02*** | (2006.01) |
| ***F04B 1/00*** | (2006.01) |
| ***F04B 53/00*** | (2006.01) |
| ***F04B 13/00*** | (2006.01) |
| ***F04B 49/06*** | (2006.01) |
| ***F04B 49/10*** | (2006.01) |
| *D06F 58/28* | (2006.01) |

(52) U.S. Cl.
CPC ..... *D06F 39/085* (2013.01); *F04B 1/005* (2013.01); *F04B 9/02* (2013.01); *F04B 13/00* (2013.01); *F04B 23/06* (2013.01); *F04B 49/06* (2013.01); *F04B 49/065* (2013.01); *F04B 49/106* (2013.01); *F04B 53/006* (2013.01); *D06F 2058/2896* (2013.01); *F04B 2205/09* (2013.01); *F04B 2205/14* (2013.01)

(58) Field of Classification Search
CPC ..... D06F 39/022; D06F 39/085; F04B 9/02; F04B 23/06
See application file for complete search history.

(56) References Cited

FOREIGN PATENT DOCUMENTS

| | | | |
|---|---|---|---|
| CN | 102031675 | A | 4/2011 |
| CN | 102165113 | A | 8/2011 |
| EP | 2251481 | A | 11/2010 |

* cited by examiner

WASHING MACHINE AND DETERGENT DELIVERY PUMP ASSEMBLY THEREOF

CROSS-REFERENCE TO RELATED APPLICATIONS

This U.S. application claims priority under 35 U.S.C 371 to, and is a U.S. National Phase application of, the International Patent Application No. PCT/CN2013/073091, filed Mar. 22, 2013, which claims the benefit of prior Chinese Application No. 201210077617.4 filed Mar. 22, 2012. The entire contents of the above-mentioned patent applications are incorporated by reference as part of the disclosure of this U.S. application.

FIELD

The present invention relates to the field of a washing device, and more particularly to a washing machine and a detergent delivery pump assembly thereof.

BACKGROUND

Many fully-automatic washing machines in the related art employ detergent automatic delivery devices, and various detergents such as a laundry agent, a softener and a sanitizer are used to wash the clothes.

Conventionally, storage boxes for containing different detergents are disposed in the washing machine, and a plurality of liquid pumping devices are provided for sucking different types of detergents respectively. For example, when the softener needs to be added, the softener in a softener storage box is delivered into a washing tub by means of a corresponding liquid pumping system to participate in the washing.

Since a plurality of liquid pumping devices are provided, each liquid pumping device has a separate pumping structure and a separate power unit, such that the cost of the washing machine is increased, the volume of the washing machine will also be increased, and the structure of the washing machine is more complex.

SUMMARY

Embodiments of the present invention seek to solve at least one of the problems existing in the related art to at least some extent. Accordingly, the present invention is to provide a detergent delivery pump assembly for controlling the precise delivery of various detergents.

The present invention is further to provide a washing machine including the detergent delivery pump assembly.

A detergent delivery pump assembly according to embodiments of the present invention includes: a pump defining a plurality of fixed-volume chambers therein for containing detergents respectively, each fixed-volume chamber being provided with a liquid inlet valve and a liquid outlet valve; a plurality of pistons disposed in the plurality of fixed-volume chambers in one-to-one correspondence relationship and each including a piston head, the piston head being controlled to reciprocate in the fixed-volume chamber to draw or push out a fixed volume of detergent; a motor assembly; and a transmission mechanism to associate the piston heads with the motor assembly, such that the piston heads are controlled to move in the fixed-volume chambers by the motor assembly.

In addition, the detergent delivery pump assembly according to embodiments of the present invention further has the following additional technical features.

In some embodiments, each piston further includes a piston rod defining a first end connected to the piston head and a second end; the transmission mechanism includes a plurality of driving members and a plurality of linkage assemblies, the driving member defines a first end connected with the second end of a corresponding piston rod to drive the piston to reciprocate, and a second end formed with a coupling hole, a plurality of first chutes are formed in an inner wall of each coupling hole of a part of the plurality of the driving members in a circumferential direction of the coupling hole, and a plurality of second chutes are formed in an inner wall of each coupling hole of the remaining driving members in a circumferential direction of the coupling hole, the first chutes and the second chutes are sawtooth-shaped and have opposite sawtooth directions; the motor assembly is rotatable forwardly or reversely and has an output shaft passing through the coupling holes of the plurality of driving members; the plurality of linkage assemblies are mounted on the output shaft and located between the output shaft and the coupling holes respectively, the linkage assemblies are engaged in the first chutes to drive the driving members having the first chutes to rotate, and the output shaft idles relative to the driving members having the second chutes, during forward rotation of the motor assembly; and the linkage assemblies are engaged in the second chutes to drive the driving members having the second chutes to rotate and the output shaft idles relative to the driving members having the first chutes, during reverse rotation of the motor assembly.

In some embodiments, for each driving member, at least one linkage assembly cooperating with the coupling hole is mounted at a corresponding position on the output shaft in an axial direction of the output shaft.

Therefore, with the detergent delivery pump assembly according to embodiments of the present invention, by engaging the linkage assemblies with the first chutes or the second chutes, different pistons may be driven to move when the motor assembly rotates forwardly and reversely, thus avoiding provision of a plurality of power sources, and achieving controlling the delivery of different detergents by means of one power source. Therefore, it is possible to ensure the flexible and reliable controlling of the delivery of detergents, and the detergent delivery pump assembly has a compact structure, thus reducing the manufacturing cost effectively.

In some embodiments, the linkage assembly includes a linkage piece and an elastic member, the elastic member normally pushes the linkage piece toward the first chute or the second chute such that the linkage piece is in contact with a bottom wall surface and a side wall surface of the first chute or the second chute.

In some embodiments, the linkage piece defines a first end pivotably connected with the output shaft and a second end in contact with the bottom wall surface and the side wall surface of the first chute or the second chute.

In some embodiments, the second end of the linkage piece is engaged with the side wall surface of the first chute during forward rotation of the motor assembly, and the second end of the linkage piece is engaged with the side wall surface of the second chute during reverse rotation of the motor assembly.

In some embodiments, the elastic member is a spring leaf.

In some embodiments, grooves for receiving the linkage assemblies are formed in the output shaft.

In some embodiments, the driving member is a cam member to convert a rotation of the output shaft into a reciprocating motion of the piston.

In some embodiments, the liquid inlet valve and the liquid outlet valve are one-way valves.

In some embodiments, the motor assembly includes one motor controlling the plurality of piston heads via the transmission mechanism.

In some embodiments, the motor or the motor assembly controls one of the pistons to move and controls the other one of the pistons not to move.

In some embodiments, the piston head moves against a side wall surface of the fixed-volume chamber to travel a unit motion distance in a motion direction.

In some embodiments, the unit motion distance of the piston head in the motion direction is associated with sawteeth formed at an equal interval on an inner wall of the driving member in a circumferential direction thereof.

A washing machine according to embodiments of the present invention includes the detergent delivery pump assembly described above.

Therefore, with the washing machine according to embodiments of the present invention, the type of the detergent may be freely selected and the delivery amount of the detergent may be precisely controlled by means of the detergent delivery pump assembly, and the washing machine is simple and reliable to operate. In addition, the washing machine according to embodiments of the present invention is simple in structure and low in manufacturing cost.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the drawings, in which.

REFERENCE NUMERALS

Figure 1:
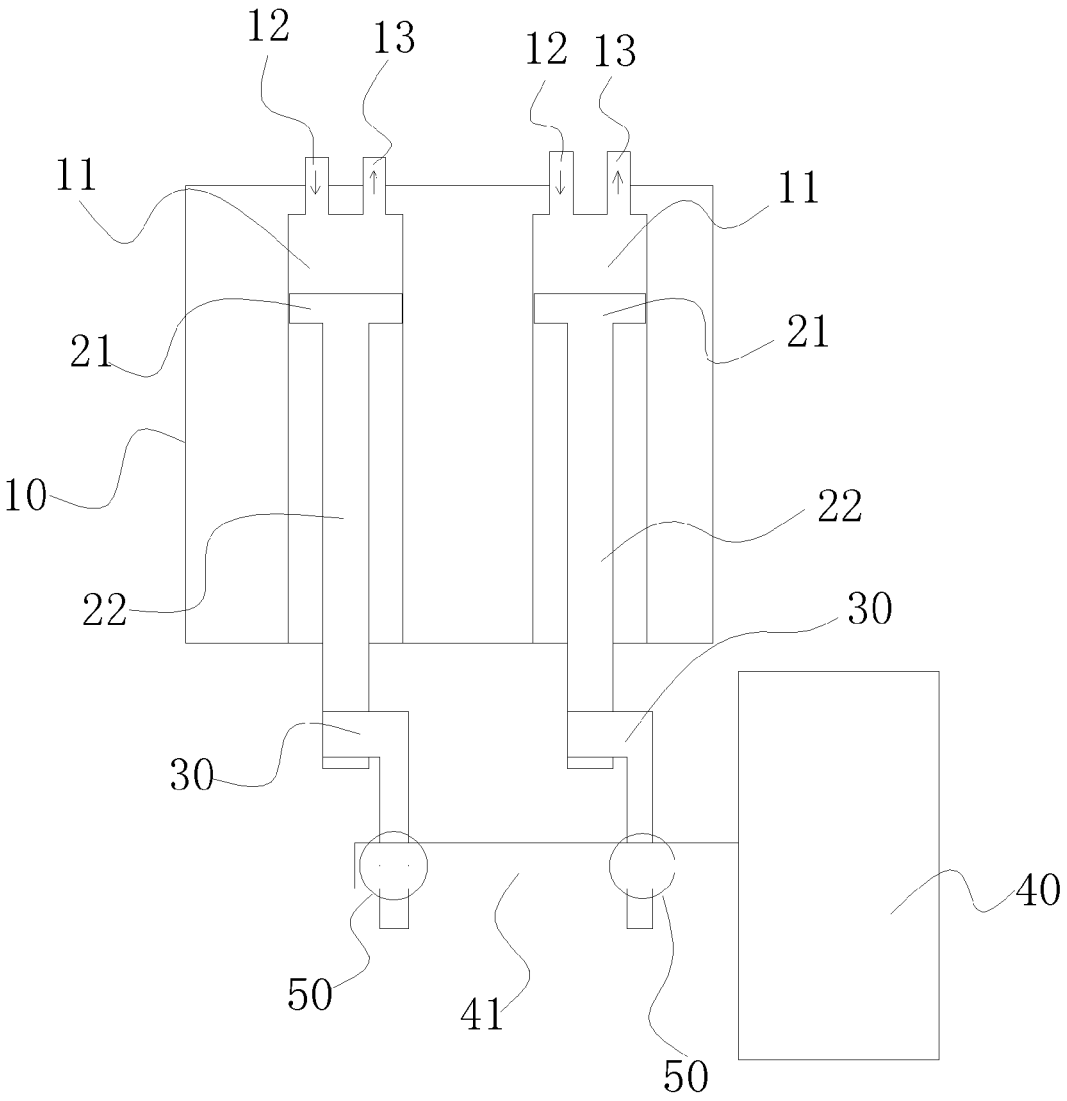
FIG. 1 is a schematic view of a detergent delivery pump assembly according to an embodiment of the present invention.

10 pump
11 fixed-volume chamber
12 liquid inlet valve
13 liquid outlet valve
20 piston
21 piston head
22 piston rod
30 driving member
31 coupling hole
32 first chute
321 bottom wall surface of first chute
322 side wall surface of first chute
33 second chute
331 bottom wall surface of second chute
332 side wall surface of second chute
40 motor assembly, motor
41 output shaft
42 groove
50 linkage assembly
51 linkage piece
52 elastic member

DETAILED DESCRIPTION

Reference will be made in detail to embodiments of the present invention. The embodiments described herein with reference to drawings are explanatory, illustrative, and used to generally understand the present invention. The embodiments shall not be construed to limit the present invention. The same or similar elements and the elements having same or similar functions are denoted by like reference numerals throughout the descriptions.

In the specification, unless specified or limited otherwise, relative terms such as "central", "longitudinal", "lateral", "up", "down", "front", "rear", "right", "left", "horizontal", "vertical", "top", "bottom", "inner", "outer" as well as derivative thereof should be construed to refer to the orientation as then described or as shown in the drawings under discussion. These relative terms are for convenience of description and do not require that the present invention be constructed or operated in a particular orientation. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A detergent delivery pump assembly according to embodiments of the present invention will be described below with reference to FIGS. 1-4.

The detergent delivery pump assembly according to embodiments of the present invention includes a pump 10, a plurality of pistons 20, a motor assembly 40, and a transmission mechanism. The transmission mechanism is used to associate the piston heads 21 with the motor assembly 40, so that one of the piston heads 21 is controlled to move in the fixed-volume chamber 11 via the motor assembly 40.

Figure 2:
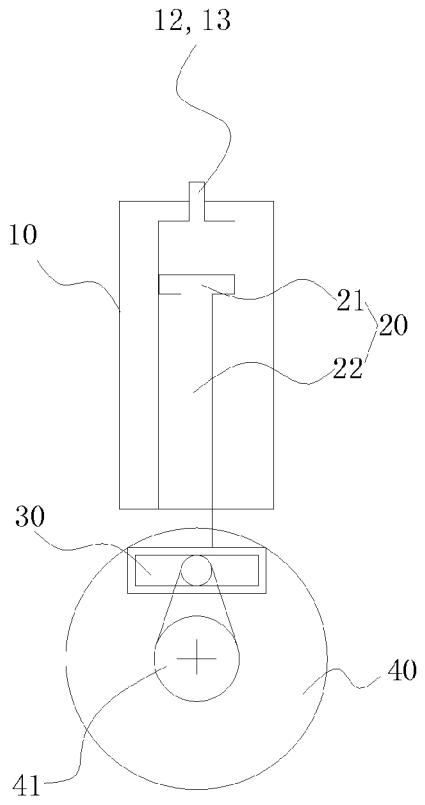
FIG. 2 is a side view of a detergent delivery pump assembly according to an embodiment of the present invention.

Particularly, as shown in FIGS. 1-2, a plurality of fixed-volume chambers or delivery boxes 11 for containing different detergents are formed in the pump 10, for example, three fixed-volume chambers or delivery boxes 11 are formed in the pump 10 for containing a laundry agent, a softener and a sanitizer respectively. At an end of each fixed-volume chamber 11, a liquid inlet valve 12 only allowing the detergent to enter the fixed-volume chamber 11 and a liquid outlet valve 13 only allowing the detergent to flow out of the fixed-volume chamber 11 are disposed. The liquid inlet valve 12 and the liquid outlet valve 13 may be one-way valves.

The plurality of pistons 20 are disposed in the plurality of fixed-volume chambers 11 in one-to-one correspondence relationship, and each piston 20 includes a piston head 21 and a piston rod 22 having a first end connected with the piston head 21 and a second end. The piston head 21 is driven by the piston rod 22 to reciprocate in the fixed-volume chamber 11, such that the detergent is sucked into the fixed-volume chamber 11 via the liquid inlet valve 12, or pushed out of the fixed-volume chamber 11 via the liquid outlet valve 13. In other words, the piston head 21 is controlled to reciprocate to draw a fixed-volume of detergent into the fixed-volume chamber 11 or push a fixed volume of detergent out of the fixed-volume chamber or delivery box 11.

Particularly, the piston head 21 moves against a side wall surface of the fixed-volume chamber 11 to travel a unit motion amount or a unit motion distance in a motion direction.

Figure 3:
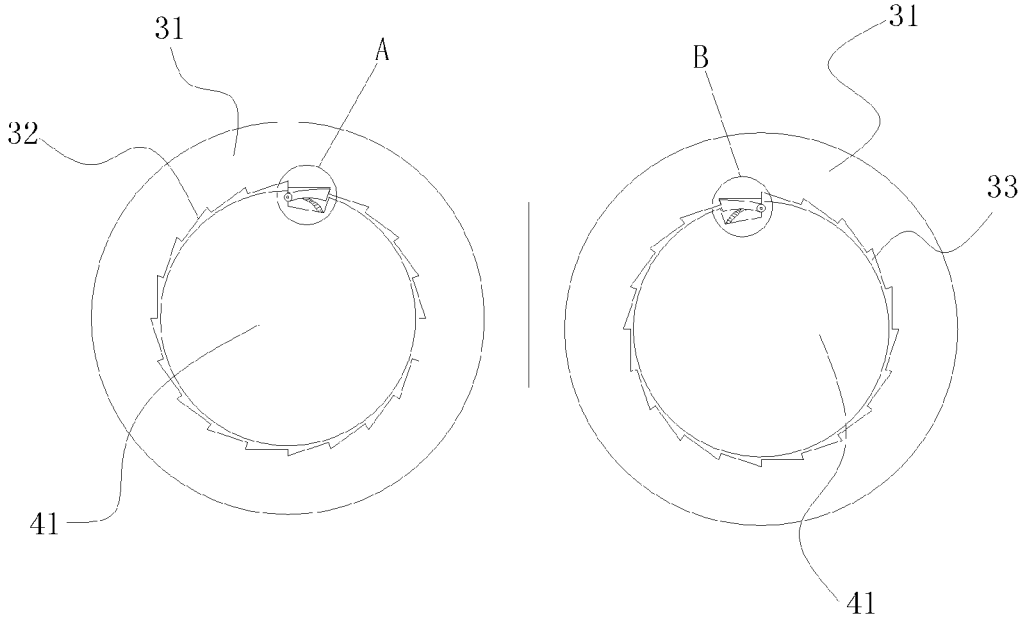
FIG. 3 is a sectional view showing the cooperating between coupling holes of driving members and an output shaft of a detergent delivery pump assembly according to an embodiment of the present invention.

As shown in FIG. 3, the transmission mechanism includes a plurality of driving members 30 and a plurality of linkage assemblies 50. A first end of each of the plurality of driving members 30 is connected with a second end of a corresponding one of the piston rods 22 to drive the corresponding piston to reciprocate, a second end of each of the plurality of driving members 30 is formed with a coupling hole 31 therein. A plurality of first sawteeth are formed at an equal interval on an inner wall of each coupling hole 31 of some of the driving members 30 in a circumferential direction of the coupling hole 31, such that a plurality of first chutes 32 of sawtooth-shape are formed in the inner wall of the coupling hole 31. A plurality of second sawteeth are formed at an equal interval on an inner wall of each coupling hole 31 of the remaining driving members 30 in a circumferential direction of the coupling hole 31 of the remaining driving members 30, such that a plurality of second chutes 33 of sawtooth-shape are formed in the inner wall of the coupling hole 31. The first chutes 32 and the second chutes 33 have opposite sawtooth directions. In some embodiments, the unit motion distance of the piston head 21 in the motion direction is associated with the sawteeth (the chute) formed at an equal interval on the inner wall of the driving member 30 in the circumferential direction. In other words, when the driving member 30 moves by one sawtooth or the sawtooth moves over a fixed unit distance, the piston head 21 also moves over a unit motion amount in the fixed-volume chamber 11, such that the delivery amount of the detergent may be precisely controlled.

In some embodiments, the motor assembly 40 includes one motor to control the plurality of piston heads 21 via the transmission mechanism. In one embodiment, the one motor or the one motor assembly controls one of the pistons to move and controls the other one of the pistons not to move.

The motor assembly 40 is rotatable in a forward direction or a reverse direction, and an output shaft 41 of the motor assembly 40 passes through the coupling holes 31 of the plurality of driving members 30, i.e. the plurality of the coupling holes 31 are fitted over the output shaft 41 at intervals in an axial direction of the output shaft 41.

The plurality of linkage assemblies 50 are mounted on the output shaft 41, and located at positions on the output shaft 41 corresponding to the coupling holes 31 of the driving members 30 respectively, so as to ensure that each coupling hole 31 is cooperated with at least one linkage assembly 50. When the coupling holes 31 are fitted over the output shaft 41, the linkage assemblies 50 are located between the output shaft 41 and the coupling holes 31 respectively.

When the motor 40 rotates forwardly, e.g., clockwise, the linkage assemblies 50 are engaged in the first chutes 32 to drive the driving members 30 having the first chutes 32 to rotate so as to drive the corresponding pistons 20 to reciprocate, and the linkage assemblies 50 are not engaged in the second chutes 33 of the driving members 30 having the second chutes 33, so that the output shaft 41 idles relative to the driving members 30 having the second chutes 33 so as not to drive the corresponding pistons 20 to move.

When the motor 40 rotates reversely, e.g., anticlockwise, the linkage assemblies 50 are engaged in the second chutes 33 to drive the driving members 30 having the second chutes 33 to rotate so as to drive the corresponding pistons 20 to reciprocate, and the linkage assemblies 50 are not engaged in the first chutes 32 of the driving members 30 having the first chutes 32, so that output shaft 41 idles relative to the driving members 30 having the first chutes 32 so as not to drive the corresponding pistons 20 to move.

For example, the driving members 30 corresponding to the fixed-volume chambers 11 containing a laundry agent and a sanitizer have the first chutes 32, and the driving members 30 corresponding to the fixed-volume chambers 11 containing a softener have the second chutes 33. When the motor assembly 40 rotates forwardly, the detergent delivery pump assembly delivers the laundry agent and the sanitizer simultaneously. When the motor assembly 40 rotates reversely, the detergent delivery pump assembly delivers the softener.

With the detergent delivery pump assembly according to embodiments of the present invention, the type of the detergent and the combination of delivery manners of detergents may be adjusted by adjusting the structure of the detergent delivery pump assembly.

Therefore, with the detergent delivery pump assembly according to embodiments of the present invention, by engaging the linkage assemblies 50 with the first chutes 32 or the second chutes 33 selectively, different pistons may be driven to move when the motor assembly 40 rotates forwardly and reversely, thus avoiding provision of a plurality of power sources, and achieving controlling the delivery of different detergents by means of one power source. Therefore, it is possible to ensure the flexible and reliable controlling of the delivery of detergents, and the detergent delivery pump assembly has a compact structure, thus reducing the manufacturing cost effectively.

In some embodiments, two fixed-volume chambers 11 for containing a laundry agent and a softener are formed in the pump 10.

For each driving member 30, at least one linkage assembly 50 cooperating with the coupling hole 31 is disposed at a corresponding position on the output shaft 41. When more than one linkage assembly 50 is cooperated with each driving member 30, the linkage assemblies 50 are disposed at corresponding positions on the output shaft 41 in an axial direction of the output shaft 41, such that the output shaft 41 may drive the driving member 30 with an increased transmission force. In this embodiment, by way example and without limitation, each driving member 30 is corresponded to one linkage assembly 50.

Figure 4:
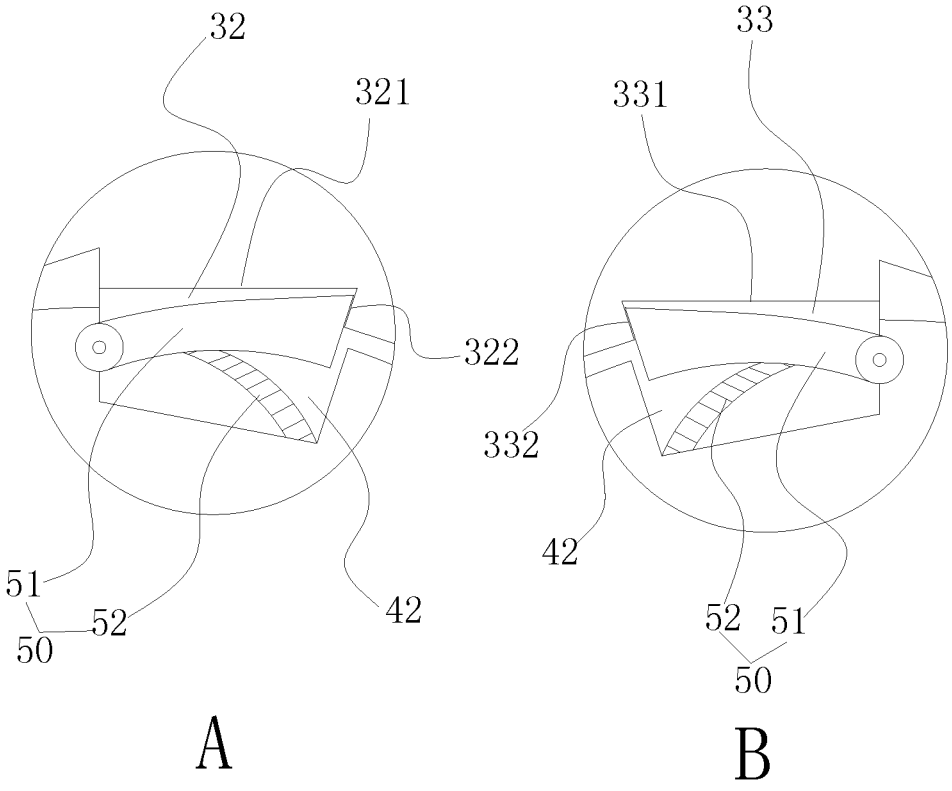
FIG. 4 is a partial enlarged view of parts A and B in FIG. 3.

As shown in FIG. 4, the linkage assembly 50 includes a linkage piece 51 and an elastic member 52. The elastic member 52 normally pushes the linkage piece 51 toward the first chute 32 or the second chute 33, such that the linkage piece 51 is in contact with a bottom wall surface 321 and a side wall surface 322 of the first chute 32 or a bottom wall 331 and a side wall surface 332 of the second chute 33.

A first end of the linkage piece 51 is pivotably connected to the output shaft 41 to rotate about a pivot point under the pushing of the elastic member 52, and a second end of the linkage piece 51 is extended into the first chute 32 or the second chute 33 and in contact with the bottom wall surface 321 and the side wall surface 322 of the first chute 32 or the bottom wall surface 331 and the side wall surface 332 of the second chute 33.

The second end of the linkage piece 51 on the left in FIG. 4 is engaged with the side wall surface 322 of the first chute 32, and such an engagement is maintained under the normal pushing of the elastic member 52. Therefore, when the motor assembly 41 rotates forwardly, the second end of the linkage piece 51 drives the driving member 30 to rotate forwardly along with the output shaft 41 by means of such an engagement so as to drive the piston in the fixed-volume chamber containing the laundry agent. At this time, since the second end of the linkage piece 51 on the right in FIG. 4 is not engaged with the side wall surface 332 of the second chute 33 in the forward direction, the linkage piece 51 only moves up and down under the pushing force of the elastic member 52, and linkage movement will not occur, such that the output shaft 41 (the linkage piece 51) idles relative to the driving member 30 on the right and the softener will not be delivered.

Similarly, when the motor assembly 40 rotates reversely, the second end of the linkage piece 51 on the right in FIG. 4 is engaged with the side wall surface 332 of the second chute 33 to drive the driving member 30 to rotate reversely along with the output shaft 41 by means of such an engagement so as to drive the piston in the fixed-volume chamber containing the softener. At this time, the linkage piece 51 as well as the output shaft 41 idles relative to the driving member 30 on the left, and the laundry agent will not be delivered.

Preferably, the elastic member is a spring leaf. By using the spring leaf, the manufacturing cost may be reduced, and the space for the linkage assembly 50 will not be over-large.

Grooves 42 for receiving the linkage assemblies 50 may be formed in the output shaft 41, so as to facilitate the mounting of the linkage assemblies 50 and enhance the mounting firmness of the linkage assemblies 50.

The driving members 30 may be any mechanisms which are capable of converting the rotation of the motor assembly 40 into the reciprocating motion of the piston rods 22, by way of example and without limitation, the driving members 30 may be a cam member.

A washing machine according to an embodiment of the present invention will be described below.

The washing machine according to embodiments of the present invention includes the detergent delivery pump assembly described with reference to the above embodiments. The liquid inlet valves 12 of the detergent delivery pump assembly are connected with different detergent sources in the washing machine respectively, so as to suck the detergents into the corresponding fixed-volume chambers 11 by the movement of the pistons 20. Then, the detergents are pushed out via the liquid outlet valves 13 by means of the pistons 20, and delivered into a washing tub.

Therefore, with the washing machine according to embodiments of the present invention, the type of the detergent may be freely selected by means of the detergent delivery pump assembly, and the washing machine is simple and reliable to operate. In addition, the washing machine according to embodiments of the present invention is simple in structure and low in manufacturing cost.

Other components of the washing machine according to embodiments of the present invention may be well known to those skilled in the art, so the detailed description thereof will be omitted here.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A detergent delivery pump assembly, comprising:

a pump defining a plurality of fixed-volume chambers therein for containing detergents respectively, each fixed-volume chamber being provided with a liquid inlet valve and a liquid outlet valve;

a plurality of pistons disposed in the plurality of fixed-volume chambers in one-to-one correspondence relationship and each comprising a piston head, the piston head being controlled to reciprocate in the fixed-volume chamber to draw or push out a fixed volume of detergent;

a motor assembly; and a transmission mechanism to associate the piston heads with the motor assembly, such that the piston heads are controlled to move in the fixed-volume chambers by the motor assembly;

wherein each piston further comprises a piston rod defining a first end connected to the piston head and a second end;

wherein the transmission mechanism comprises a plurality of driving members and a plurality of linkage assemblies, wherein the driving member defines a first end connected with the second end of a corresponding piston rod to drive the piston to reciprocate, and a second end formed with a coupling hole, wherein a plurality of first chutes are formed in an inner wall of each coupling hole of a part of the plurality of the driving members in a circumferential direction of the coupling hole, and a plurality of second chutes are formed in an inner wall of each coupling hole of the remaining driving members in a circumferential direction of the coupling hole, wherein the first chutes and the second chutes are sawtooth-shaped and have opposite sawtooth directions;

wherein the motor assembly is rotatable forwardly or reversely and has an output shaft passing through the coupling holes of the plurality of driving members;

wherein the plurality of linkage assemblies are mounted on the output shaft and located between the output shaft and the coupling holes respectively, the linkage assemblies are engaged in the first chutes to drive the driving members having the first chutes to rotate, and the output shaft idles relative to the driving members having the second chutes, during forward rotation of the motor assembly; and the linkage assemblies are engaged in the second chutes to drive the driving members having the second chutes to rotate and the output shaft idles relative to the driving members having the first chutes, during reverse rotation of the motor assembly.

2. The detergent delivery pump assembly according to claim 1, wherein for each driving member, at least one linkage assembly cooperating with the coupling hole is mounted at a corresponding position on the output shaft in an axial direction of the output shaft.

3. The detergent delivery pump assembly according to claim 1, wherein the linkage assembly comprises a linkage piece and an elastic member, the elastic member normally pushes the linkage piece toward the first chute or the second chute such that the linkage piece is in contact with a bottom wall surface and a side wall surface of the first chute or the second chute.

4. The detergent delivery pump assembly according to claim 3, wherein the linkage piece defines a first end pivotably connected with the output shaft and a second end in contact with the bottom wall surface and the side wall surface of the first chute or the second chute.

5. The detergent delivery pump assembly according to claim 4, wherein the second end of the linkage piece is engaged with the side wall surface of the first chute during forward rotation of the motor assembly, and the second end of the linkage piece is engaged with the side wall surface of the second chute during reverse rotation of the motor assembly.

6. The detergent delivery pump assembly according to claim 3, wherein the elastic member is a spring leaf.

7. The detergent delivery pump assembly according to claim 1, wherein grooves for receiving the linkage assemblies are formed in the output shaft.

8. The detergent delivery pump assembly according to claim 1, wherein the driving member is a cam member to convert a rotation of the output shaft into a reciprocating motion of the piston.

9. The detergent delivery pump assembly according to claim 1, wherein the liquid inlet valve and the liquid outlet valve are one-way valves.

10. The detergent delivery pump assembly according to claim 1, wherein the motor assembly comprises one motor controlling the plurality of piston heads via the transmission mechanism.

11. The detergent delivery pump assembly according to claim 10, wherein the motor controls one of the pistons to move and controls the other one of the pistons not to move.

12. The detergent delivery pump assembly according to claim 1, wherein the motor assembly controls one of the pistons to move and controls the other one of the pistons not to move.

13. The detergent delivery pump assembly according to claim 1, wherein the piston head moves against a side wall surface of the fixed-volume chamber to travel a unit motion distance in a motion direction.

14. The detergent delivery pump assembly according to claim 1, wherein unit motion distance of the piston head in motion direction is associated with sawteeth formed at an equal interval on an inner wall of the driving member in a circumferential direction thereof.

15. The detergent delivery pump assembly according to claim 14, wherein the unit motion distance of the piston head in the motion direction is associated with sawteeth formed at an equal interval on an inner wall of the driving member in a circumferential direction thereof.

16. A washing machine comprising a detergent delivery pump assembly, wherein the detergent delivery pump assembly comprises:

a pump defining a plurality of fixed-volume chambers therein for containing detergents respectively, each fixed-volume chamber being provided with a liquid inlet valve and a liquid outlet valve;

a plurality of pistons disposed in the plurality of fixed-volume chambers in one-to-one correspondence relationship and each comprising a piston head, the piston head being controlled to reciprocate in the fixed-volume chamber to draw or push out a fixed volume of detergent;

a motor assembly; and a transmission mechanism to associate the piston heads with the motor assembly, such that the piston heads are controlled to move in the fixed-volume chambers by the motor assembly;

wherein each piston further comprises a piston rod defining a first end connected to the piston head and a second end;

wherein the transmission mechanism comprises a plurality of driving members and a plurality of linkage assemblies, wherein the driving member defines a first end connected with the second end of a corresponding piston rod to drive the piston to reciprocate, and a second end formed with a coupling hole, wherein a plurality of first chutes are formed in an inner wall of each coupling hole of a part of the plurality of the driving members in a circumferential direction of the coupling hole, and a plurality of second chutes are formed in an inner wall of each coupling hole of the remaining driving members in a circumferential direction of the coupling hole, wherein the first chutes and the second chutes are sawtooth-shaped and have opposite sawtooth directions;

wherein the motor assembly is rotatable forwardly or reversely and has an output shaft passing through the coupling holes of the plurality of driving members;

wherein the plurality of linkage assemblies are mounted on the output shaft and located between the output shaft and the coupling holes respectively, the linkage assemblies are engaged in the first chutes to drive the driving members having the first chutes to rotate, and the output shaft idles relative to the driving members having the second chutes, during forward rotation of the motor assembly; and the linkage assemblies are engaged in the second chutes to drive the driving members having the second chutes to rotate and the output shaft idles relative to the driving members having the first chutes, during reverse rotation of the motor assembly.

* * * * *